US010207851B1

(12) United States Patent
Shigihara et al.

(10) Patent No.: US 10,207,851 B1
(45) Date of Patent: Feb. 19, 2019

(54) INSULATING CONTAINER WITH INTERLOCKING PANELS

(71) Applicant: Amazon Technologies, Inc., Reno, NV (US)

(72) Inventors: Patricia Terumi Yoshida Shigihara, Seattle, WA (US); William Anthony Lopes, Long Beach, CA (US); David Dzung Lu, Huntington Beach, CA (US)

(73) Assignee: Amazon Technologies, Inc., Seattle, WA (US)

( * ) Notice: Subject to any disclaimer, the term of this patent is extended or adjusted under 35 U.S.C. 154(b) by 787 days.

(21) Appl. No.: 14/132,503

(22) Filed: Dec. 18, 2013

(51) Int. Cl.
*B65D 81/18* (2006.01)
*B65D 81/107* (2006.01)
*B65D 5/32* (2006.01)

(52) U.S. Cl.
CPC ..... *B65D 81/18* (2013.01); *B65D 81/1075* (2013.01); *B65D 5/32* (2013.01)

(58) Field of Classification Search
CPC ..... B65D 81/1075; B65D 5/32; B65D 81/18
USPC ..... 220/592.2, 4.28; 206/521, 527; 229/198.2; 217/12 R, 43 R
See application file for complete search history.

(56) References Cited

U.S. PATENT DOCUMENTS

| | | | | |
|---|---|---|---|---|
| 3,791,002 | A * | 2/1974 | Lampe et al. | 29/897 |
| 4,196,817 | A * | 4/1980 | Moser | 215/12.1 |
| 4,270,304 | A * | 6/1981 | Sofer | 446/106 |
| 5,285,656 | A * | 2/1994 | Peters | 62/457.1 |
| 2011/0155729 | A1* | 6/2011 | Hall | 220/4.28 |
| 2011/0309072 | A1* | 12/2011 | Rio Gonzalez et al. | 220/4.28 |

* cited by examiner

*Primary Examiner* — Anthony D Stashick
*Assistant Examiner* — James M Van Buskirk
(74) *Attorney, Agent, or Firm* — Thomas Horstemeyer, LLP

(57) ABSTRACT

Disclosed are various embodiments for a container that comprises multiple interlocking panels. According to various embodiments, a first panel includes a first notch, a second notch, a third notch, and a fourth notch. A second panel includes a first tab that is configured to be inserted into the first notch of the first panel. A third panel includes a second tab that is configured to be inserted into the second notch of the first panel. A fourth panel includes a third tab that is configured to be inserted into the third notch of the first panel. A fifth panel includes a fourth tab that is configured to be inserted into the fourth notch of the first panel.

21 Claims, 8 Drawing Sheets

INSULATING CONTAINER WITH INTERLOCKING PANELS

BACKGROUND

An item, such as food or medicine, may have its temperature regulated for various reasons. For example, an item may be refrigerated to prevent the item from becoming spoiled. If the item is to be transported to a subsequent location, the item may be loaded into a climate-controlled truck or trailer so that the temperature of the item may be regulated during transport of the item.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure is directed towards a container that may be used to store and/or transport various types of items. As a non-limiting example, the container according to various embodiments may include multiple interlocking panels. In this regard, the container may be assembled by attaching each panel to at least one other panel. Items, such as food and/or medicine, may be positioned in the container, and the container along with the items therein may be transported to a destination. Additionally, a heating element or a refrigerating element may be positioned in the container. In some embodiments, the panels may be constructed of a material that functions as a relatively effective thermal insulator. As such, the temperature of the items may be maintained within desired limits while the items are transported in the container. After the container has arrived at its destination, the items may be removed from the container. Additionally, the container may be disassembled by separating the panels that form the container. The panels for the disassembled container may occupy less volume than the assembled container would otherwise occupy. Additionally, it may be easier to clean the panels individually than to clean the container when it is assembled. After the panels have been cleaned, the panels may be reused for the same container or for one or more other containers. Furthermore, if the container becomes damaged, the particular one or more panels that are damaged may be replaced instead of replacing the entire container 100.

In the following discussion, a general description of the system and its components is provided, followed by a discussion of the operation of the same.

Figure 1:
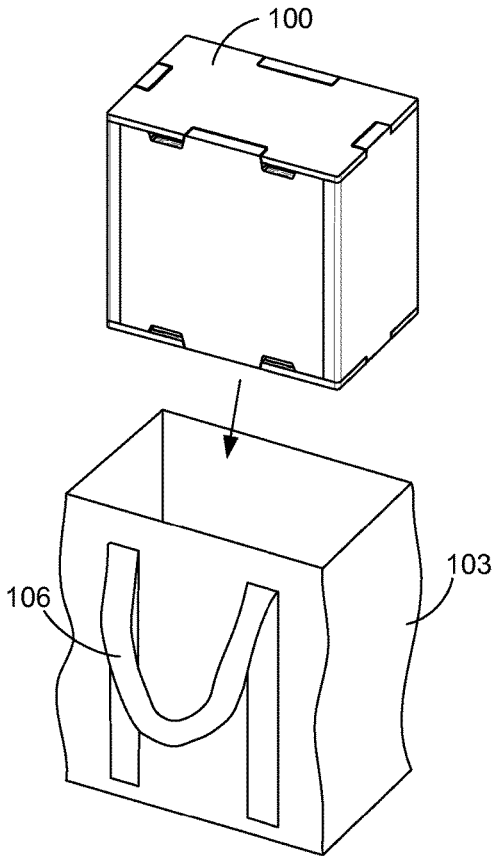
FIG. 1 is a drawing of an example of a container being positioned in a tote bag according to various embodiments of the present disclosure.

With reference to FIG. 1, shown is a container 100 being inserted into a tote bag 103 according to various embodiments of the present disclosure. One or more items (not shown) may be positioned in a cavity formed by the container 100. The container 100 along with the one or more items therein may be transported to a destination, such as a home, business, storage facility, and/or any other location. According to various embodiments, an item may be a perishable item, such as food, medicine, etc. Additionally, an item such as a heating element, a refrigerating element, and/or any other type of physical article may be positioned within the container 100.

In some embodiments, it may be desirable to maintain the temperature of the item within predetermined limits to, for example, prevent the item from spoiling or for other purposes. As such, various embodiments of the container 100 may be constructed of a thermal insulator. As a result, the temperature of the environment within the container 100 may be maintained within predefined limits while the one or more items are located therein.

The dimensions of the container 100 may be chosen so that the container 100 is configured to fit within various types of carrying articles. As a non-limiting example, the container 100 may be configured to fit in the tote bag 103. Such a tote bag 103 may be constructed of a flexible fabric and have one or more straps 106. The straps 106 may facilitate a person lifting and carrying the tote bag 103 along with the container 100 therein.

The container 100 may be used in conjunction with a grocery delivery service. As a non-limiting example, a customer may order a frozen item, such as a frozen pizza, from the grocery delivery service. A worker for the grocery delivery service may retrieve the ordered item and place the ordered item and refrigerating elements, such as ice packs, in the cavity formed by the container 100. The container 100 with the ordered item and refrigerating elements therein may then be placed in the tote bag 103. Thereafter, the tote bag 103 with the container 100 therein may be delivered to a destination. At the destination, the customer that ordered the item may obtain the tote bag 103 with the container 100, and the customer may carry the container 100 using the tote bag 103.

Figure 2:
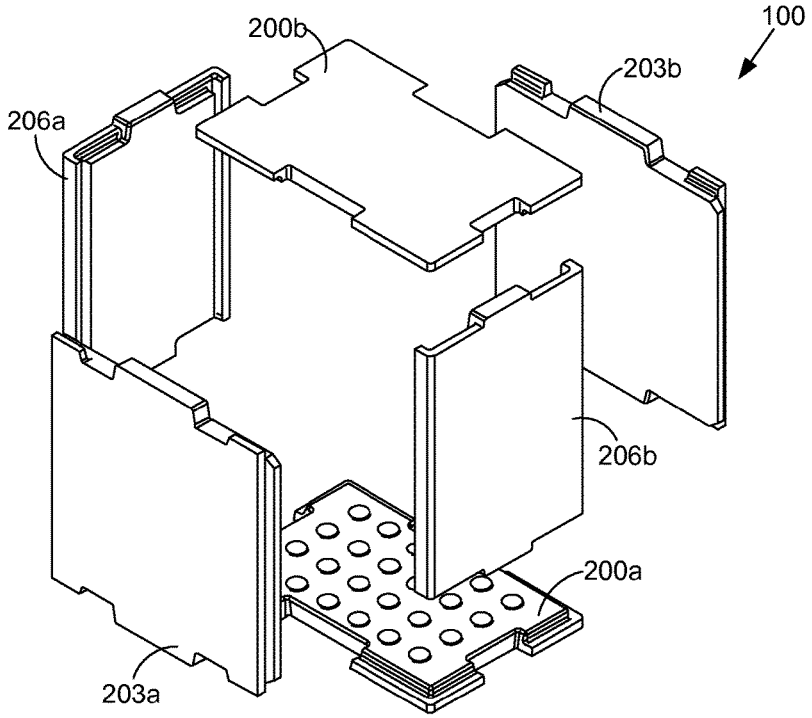
FIG. 2 is a drawing of the container of FIG. 1 according to various embodiments of the present disclosure.

With reference to FIG. 2 shown is an exploded view of an example of the container 100 according to various embodiments. As shown, the container 100 may comprise multiple panels 200*a*-200*b*, 203*a*-203*b*, and 206*a*-206*b*. The container 100 shown in FIG. 2 is formed of a first panel 200*a*, a second panel 200*b*, a third panel 203*a*, a fourth panel 203*b*, a fifth panel 206*a*, and a sixth panel 206*b*. However, the container 100 in alternative embodiments may be formed of fewer or more than the six panels 200*a*-200*b*, 203*a*-203*b* and 206*a*-206*b* that are shown in FIG. 2. The present disclosure will refer to the first panel 200*a* as the bottom panel 200*a*, the second panel 200*b* as the top panel 200*b*, the third panel 203*a* as the front panel 203*a*, the fourth panel 203*b* as the rear panel 203*b*, the fifth panel 206*a* as the left panel 206*a*, and the sixth panel 206*b* as the right panel 206*b*. It is understood that the relative terms "bottom," "front," "left," "right," "rear," and "top" are being used herein merely to facilitate the discussion of the respective components of the container 100 in the orientation shown in FIG. 2. It is understood that the container 100 shown in FIG. 2 may be positioned in other spatial orientations according to alternative embodiments.

The panels 200*a*-200*b*, 203*a*-203*b*, and 206*a*-206*b* may be regarded as being interlocking panels 200*a*-200*b*, 203*a*-203*b*, and 206*a*-206*b*. In this sense, each of the panels 200*a*-200*b*, 203*a*-203*b*, and 206*a*-206*b* is configured to attach to one or more of the other panels 200*a*-200*b*, 203*a*-203*b*, and 206*a*-206*b* to form the container 100, as will be described below. In the embodiment shown in FIG. 2, each of the panels 200*a*-200*b*, 203*a*-203*b*, and 206*a*-206*b* is configured to attach to four of the other panels 200*a*-200*b*, 203*a*-203*b*, and 206*a*-206*b*. For example, the front panel 203*a* in FIG. 2 is configured to attach to the bottom panel 200*a*, the left panel 206*a*, the right panel 206*b*, and the top panel 200*b*.

The panels 200*a*-200*b*, 203*a*-203*b*, and 206*a*-206*b* in various embodiments may be constructed of various types of materials. In some embodiments, the panels 200*a*-200*b*, 203*a*-203*b*, and 206*a*-206*b* may be constructed of a material that functions as a relatively efficient thermal insulator. As non-limiting examples, the panels 200*a*-200*b*, 203*a*-203*b*, and 206*a*-206*b* may be constructed of rubber, plastic, and/or a closed-cell foam, such as expanded polystyrene (EPS) and/or any other suitable closed-cell foam. Such materials may resist stains and contamination and also facilitate the cleaning of the panels 200*a*-200*b*, 203*a*-203*b*, and 206*a*-206*b*. At least a portion of the panels 200*a*-200*b*, 203*a*-203*b* may be compressible and/or pliable to facilitate the formation of detachable joints between the various interconnecting portions of the panels 200*a*-200*b*, 203*a*-203*b*, and 206*a*-206*b*. In some embodiments, the panels 200*a*-200*b*, 203*a*-203*b*, and 206*a*-206*b* may include rigid structural members (not shown) that may provide structural support, and another material, such as a closed-cell foam, may surround the rigid structural members. Such rigid structural members may comprise metal, plastic, and/or any other suitable material. In some embodiments, the panels 200*a*-200*b*, 203*a*-203*b*, and 206*a*-206*b* may comprise a relatively rigid material, such as metal, plastic, wood, or any other suitable material, and a compressible and/or pliable coating may cover at least a portion of the relatively rigid material. Such a coating may comprise, rubber, plastic, foam, and/or any other suitable material.

In the embodiment shown in FIG. 2, the bottom panel 200*a* and the top panel 200*b* are substantially identical. In this regard, the bottom panel 200*a* and the top panel 200*b* have substantially the same features and dimensions. Thus, if the panels 200*a*-200*b* are constructed using a molding-process, the bottom panel 200*a* and the top panel 200*b* may be constructed using the same mold. By the bottom panel 200*a* and the top panel 200*b* being constructed from the same mold, the tooling costs for the container 100 may be less than would otherwise result if the bottom panel 200*a* and the top panel 200*b* were constructed from different molds. Similarly, the front panel 203*a* and the rear panel 203*b* in the embodiment shown in FIG. 2 are substantially identical. Furthermore, the left panel 206*a* and the right panel 206*b* in the embodiment shown in FIG. 2 can be substantially identical. Thus, the entire container 100 may be formed of three different types of panels 200*a*-200*b*, 203*a*-203*b*, and 206*a*-206*b*.

Figure 3A:
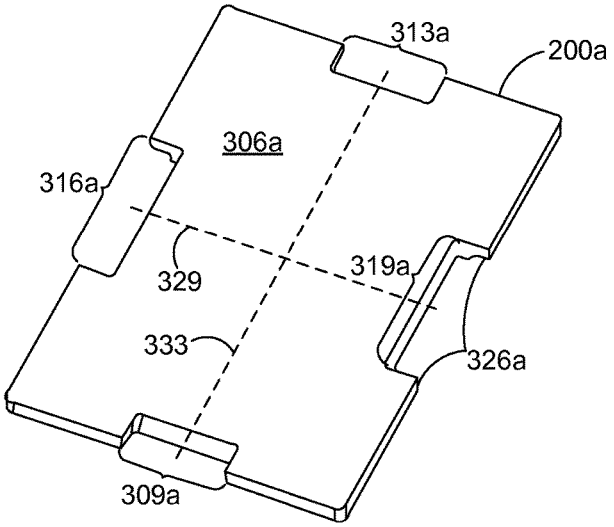
FIGS. 3A-3B are drawings of a first example of a panel of the container of FIG. 1 according to various embodiments of the present disclosure.
Figure 3B:
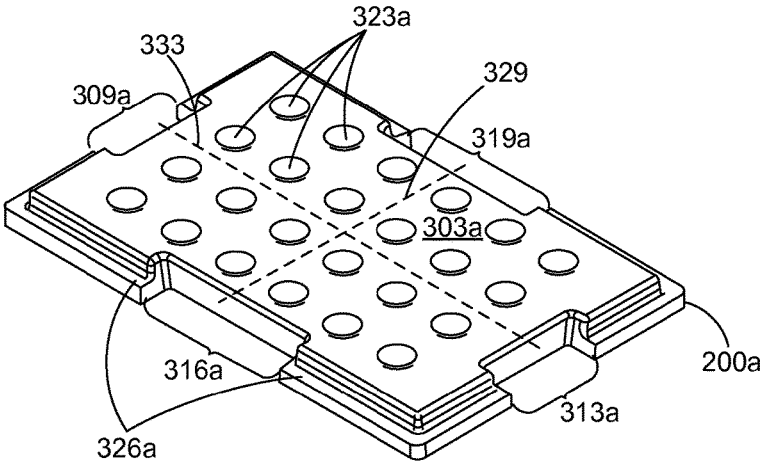

With reference to FIGS. 3A-3B, shown are drawings of an example of the bottom panel 200*a* for the container 100 (FIG. 1) according to various embodiments. As mentioned above, the top panel 200*b* (FIG. 2) for the container 100 may be substantially the same as the bottom panel 200*a* that is shown in FIGS. 3A-3B.

The bottom panel 200*a* may include an interior surface 303*a* (not visible in FIG. 3A), an exterior surface 306*a* (not visible in FIG. 3B), one or more notches 309*a*-319*a*, one or more protrusions 323*a* (not visible in FIG. 3A), a lip 326*a*, and/or other components. The exterior surface 306*a* may be the side of the bottom panel 200*a* that faces away from the enclosed region of the container 100 when the container 100 is assembled. The interior surface 303*a* of the bottom panel 200*a* may be the side of the bottom panel 200*a* that faces the enclosed region of the container 100 when the container 100 is assembled.

The protrusions 323*a* may be portions of the bottom panel 200*a* that are extended outward from the interior surface 303*a* of the bottom panel 200*a*. In various embodiments, bottom panel 200*a*, the top panel 200*b*, the front panel 203*a* (FIG. 2), the rear panel 203*b* (FIG. 2), the left panel 206*a* (FIG. 2), and/or the right panel 206*b* (FIG. 2) may have respective protrusions 323*a*. An item in the container 100 may contact the protrusions 323*a*, thereby positioning the item at a distance away from the interior surface 303*a*. Because the protrusions 323*a* may provide space between interior surface 303*a* and an item in the container 100, the protrusions 323*a* may facilitate the circulation of air around the sides of the item within the container 100. Thus, if there is a heating element or a refrigerating element in the container 100, the protrusions 323*a* may facilitate one or more sides of an item being exposed to the air that has been heated or cooled. As a result, heat transfer between a heating element or a refrigerating element and an item in the container 100 may be facilitated.

The notches 309*a*-319*a* may receive tabs from other panels 203*a*-203*b* and 206*a*-206*b*, as will be described in further detail below. As such, the notches 309*a*-319*a* may be openings in or recessed regions of the bottom panel 200*a*. In the embodiment shown in FIGS. 3A-3B, each end of the bottom panel 200*a* is associated with a respective one of the notches 309*a*-319*a*. In alternative embodiments, each end of the bottom panel 200*a* may have multiple notches 309*a*-319*a*, or one or more ends of the bottom panel 200*a* may not have a notch 309*a*-319*a*. As will be described in further detail below, tabs from other panels 203*a*-203*b* and 206*a*-206*b* may insert into the respective notches 309*a*-319*a* to form dovetail joints. In one embodiment, the notches 309*a*-319*a* may function as "tails" for the dovetail joints.

The lip 326*a* may be a portion of the bottom panel 200*a* that extends from at least a portion of the periphery of the bottom panel 200*a*, as shown in FIGS. 3A-3B. In the embodiment shown in FIGS. 3A-3B, the exterior side of the lip 326*a* is flush with the exterior surface 306*a* of the bottom panel 200*a*. Additionally, in the embodiment shown in FIGS. 3A-3B, the lip 326*a* does not exist in the regions where the notches 309*a*-319*a* are located. As such, the lip 326*a* in the embodiment shown in FIGS. 3A-3B is a discontinuous lip 326*a*. In alternative embodiments, the lip 326*a* may extend around the entire periphery of the bottom panel 200*a* and thus be a continuous lip 326*a*.

In FIGS. 3A-3B, a first axis 329 is shown midway between the notch 309*a* and the notch 313*a*. The first axis 329 extends from the notch 316*a* to the notch 326*a*. Additionally, a second axis 333 is shown midway between the notch 316*a* and the notch 319*a*. The second axis 333 extends from the notch 309*a* and the notch 313*a*. In the embodiment shown in FIGS. 3A-3B, the bottom panel 200*a* is symmetrical with respect to the first axis 329 and the second axis 333. As such, the bottom panel 200*a* may be regarded as being two-way symmetrical.

Figure 4A:
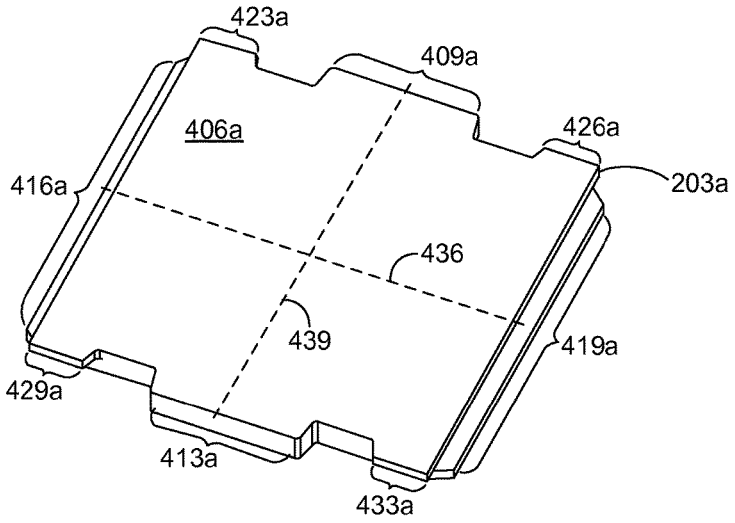
FIGS. 4A-4B are drawings of a second example of a panel of the container of FIG. 1 according to various embodiments of the present disclosure.
Figure 4B:
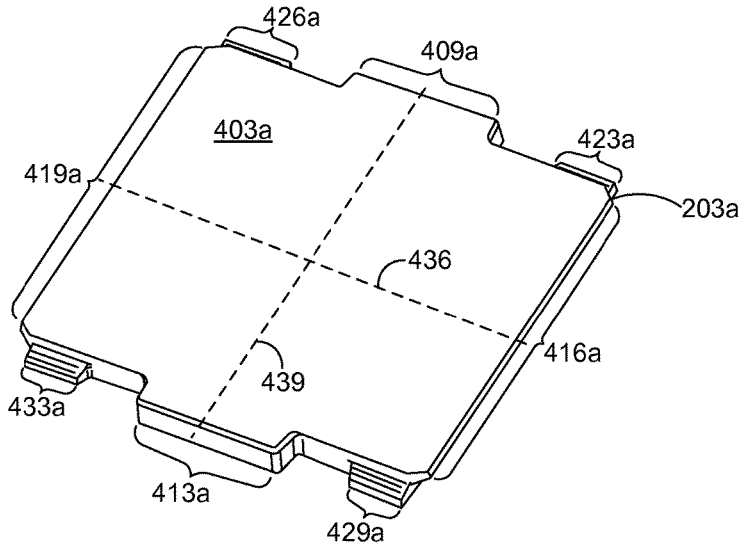

With reference to FIGS. 4A-4B, shown are drawings of an example of the front panel 203*a* for the container 100 (FIG. 1) according to various embodiments. As mentioned above, the rear panel 203*b* (FIG. 2) for the container 100 may be substantially the same as the front panel 203*a* that is shown in FIGS. 4A-4B.

The front panel 203*a* in the embodiment shown in FIGS. 4A-4B includes an interior surface 403*a* (not visible in FIG. 4A), an exterior surface 406*a* (not visible in FIG. 4B), a first tab 409*a*, a second tab 413*a*, a first fin 416*a*, a second fin 419*a*, one or more extensions 423*a*-433*a*, and/or other components. The exterior surface 406*a* may be the side of the front panel 203*a* that faces away from the enclosed region of the container 100 when the container 100 is assembled. The interior surface 403*a* of the front panel 203*a* may be the side of the front panel 203*a* that faces the enclosed region of the container 100 when the container 100 is assembled.

The first tab 409*a* may be an extended portion of an edge of the front panel 203*a*. Similarly, the second tab 413*a* may be an extended portion of another edge of the front panel 203*a*. In alternative embodiments, the front panel 203*a* may comprise multiple first tabs 409*a* and/or multiple second tabs 413*a*. The interior sides (when the container 100 is assembled) of the first tab 409*a* and the second tab 413*a* may be flush with the interior surface 403*a* of the front panel 203*a*, as shown in FIGS. 4A-4B. Similarly, the exterior sides (when the container 100 is assembled) of the first tab 409*a* and the second tab 413*a* may be flush with the exterior surface 406*a* of the front panel 203*a*, as shown in FIGS. 4A-4B. As will be discussed in further detail below, the first tab 409*a* may be inserted into one of the notches 316*a*-319*a* (FIG. 3) of the top panel 200*b* (FIG. 2), and the second tab 413*a* may be inserted into one of the notches 316*a*-319*a* of the bottom panel 200*a* (FIG. 2). Dovetail joints may be formed when the first tab 409*a* is inserted into one of the notches 316*a*-319*a* of the top panel 200*b* and when the second tab 413*a* is inserted into one of the notches 316*a*-319*a* of the bottom panel 200*a*, as will be described in more detail below. According to one embodiment, the first tab 409*a* and the second tab 413*a* may function as "pins" for the dovetail joints, and the notches 316*a*-319*a* may function as "tails" for the dovetail joints.

The first fin 416*a* may be an extended portion of an edge of the front panel 203*a*. Similarly, the second fin 419*a* may be an extended portion of another edge of the front panel 203*a*. In alternative embodiments, the front panel 203*a* may comprise multiple first fins 416*a* and/or multiple second fins 419*a*. The interior sides of the first fin 416*a* and the second fin 419*a* may be flush with the interior surface 403*a* of the front panel 203*a*, as shown in FIGS. 4A-4B. Additionally, the exterior sides of the first fin 416*a* and the second fin 419*a* may be recessed with respect to the exterior surface 406*a* of the front panel 203*a*, as shown in FIGS. 4A-4B. As will be discussed in further detail below, the first fin 416*a* may be inserted into a channel in the left panel 206*a* (FIG. 2), and the second fin 419*a* may be inserted into a channel in the right panel 206*b* (FIG. 2). When the first fin 416*a* and the second fin 419*a* have been inserted into respective channels, dado joints may be formed, as will be described below.

The extensions 423*a*-426*a* may be extended portions of the edge of the front panel 203*a* on which the first tab 409*a* is located, as shown in FIGS. 4A-4B. Similarly, the extensions 423*a*-426*a* may be extended portions of the edge of the front panel 203*a* on which the second tab 413*a* is located. As shown in FIGS. 4A-4B, the exterior sides of the extensions 423*a*-433*a* may be flush with the exterior surface 406*a* of the front panel 203*a*. Additionally, the interior sides of the extensions 423*a*-433*a* may be recessed with respect to the interior surface 403*a* of the front panel 203*a*.

As shown in FIGS. 4A-4B, there are spaces between the first tab 409*a* and the respective extensions 423*a*-426*a*. Furthermore, there are spaces between the second tab 413*a* and the respective extensions 429*a*-433*a*. As will be discussed in further detail below, when the container 100 has been assembled, a user may insert fingers or a tool into the spaces to grip and pry the front panel 203*a* from the top panel 200*b* and/or the bottom panel 200*a*.

In FIGS. 4A-4B, a first axis 436 is shown midway between the first tab 409*a* and the second tab 413*a*. The first axis 436 extends from the first fin 416*a* to the second fin 419*a*. Additionally a second axis 439 is shown midway between the first fin 416*a* and the second fin 419*a*. The second axis 439 extends from the first tab 409*a* to the second tab 413*a*. The front panel 203*a* in the embodiment shown in FIGS. 4A-4B is symmetrical with respect to the first axis 436 and the second axis 439. As such, the front panel 203*a* may be regarded as being two-way symmetrical.

Figure 5A:
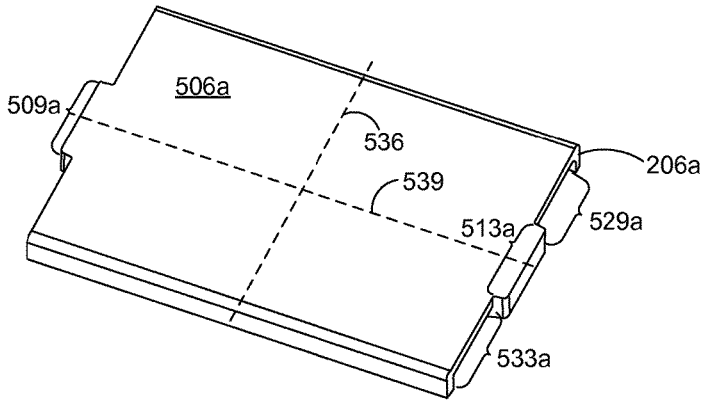
FIGS. 5A-5B are drawings of a third example of a panel of the container of FIG. 1 according to various embodiments of the present disclosure.
Figure 5B:
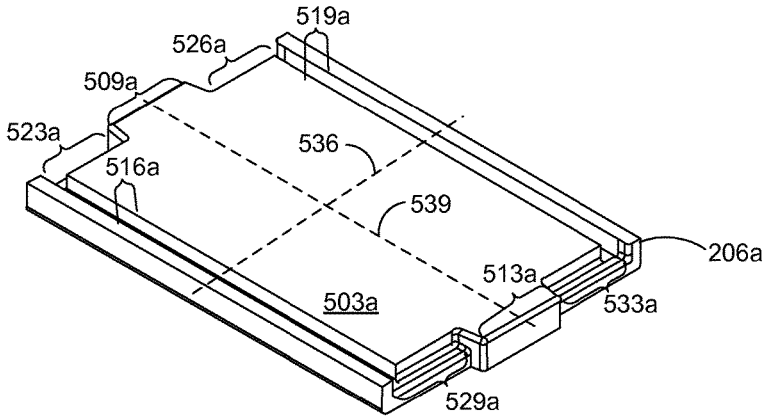

With reference to FIGS. 5A-5B, shown are drawings of an example of the left panel 206*a* for the container 100 (FIG. 1) according to various embodiments. As mentioned above, the right panel 206*b* (FIG. 2) for the container 100 may be substantially the same as the left panel 206*a* that is shown in FIGS. 5A-5B.

The left panel 206*a* according to various embodiments may include an interior surface 503*a* (not visible in FIG. 5A), an exterior surface 506*a* (not visible in FIG. 5B), a first tab 509*a*, a second tab 513*a*, a first channel 516*a* (not visible in FIG. 5A), a second channel 519*a* (not visible in FIG. 5A), one or more recesses 523*a*-533*a* (the recesses 523*a*-526*a* are not visible in FIG. 5A), and/or other components. The exterior surface 506*a* may be the side of the left panel 206*a* that faces away from the enclosed region of the container 100 when the container 100 is assembled. The interior surface 503*a* of the left panel 206*a* may be the side of the left panel 206*a* that faces the enclosed region of the container 100 when the container 100 is assembled.

The first tab 509*a* may be an extended portion of an edge of the left panel 206*a*. Similarly, the second tab 513*a* may be an extended portion of another edge of the left panel 206*a*. In alternative embodiments, the left panel 206*a* may comprise multiple first tabs 509*a* and/or multiple second tabs 513*a*. The interior sides of the first tab 509*a* and the second tab 513*a* may be flush with the interior surface 503*a* of the left panel 206*a*, as shown in FIGS. 5A-5B. Similarly, the exterior sides of the first tab 509*a* and the second tab 513*a* may be flush with the exterior surface 506*a* of the left panel 206*a*, as shown in FIGS. 5A-5B. As will be discussed in further detail below, the first tab 509*a* may be inserted into one of the notches 309*a*-313*a* (FIG. 3) of the top panel 200*b* (FIG. 2), and the second tab 513*a* may be inserted into one of the notches 309*a*-313*a* of the bottom panel 200*a* (FIG. 2). When the first tab 509*a* and the second tab 513*a* have been inserted into the respective notches 309*a*-313*a*, dovetail joints may be formed. According to one embodiment, the first tab 509*a* and the second tab 513*a* may function as "pins" for the dovetail joints, and the notches 309-313*a* may function as "tails" for the dovetail joints.

The first channel 516*a* may be a groove in the interior surface 503*a* that extends between the edge of the left panel 206*a* on which the first tab 509*a* is located and the edge of the left panel 206*a* on which the second tab 513*a* is located. Similarly, the second channel 519*a* may be a groove in the interior surface 503*a* that extends between the edge of the left panel 206*a* on which the first tab 509*a* is located and the edge of the left panel 206*a* on which the second tab 513*a* is located. In alternative embodiments, the left panel 206*a* may comprise multiple first channels 516*a* and/or multiple second channels 519*a*. As will be discussed in further detail below, the first fin 416*a* (FIGS. 4A-4B) of the front panel 203*a* may be inserted into the first channel 516*a* of the left panel 206*a*, and the second fin 419*a* (FIGS. 4A-4B) of the rear panel 203*b* may be inserted into the second channel 519*a* of the left panel 206*a*. When the first channel 516*a* and the second channel 519*a* have received the first fin 416*a* of the front panel 203*a* and the second fin 419*a* of the rear panel 203*b*, respectively, dado joints may be formed, as will be described in further detail below.

The recesses 523*a*-533*a* may be spaces that are formed by recessed regions of the interior surface 503*a* of the left panel 206*a*. As will be described below, when the container 100 has been assembled, a portion of the bottom panel 200*a* may insert into the recesses 523*a*-526*a*. Similarly, when the container 100 has been assembled, a portion of the top panel 200*b* may insert into the recesses 529*a*-533*a*.

In FIGS. 5A-5B, a first axis 536 is shown midway between the first tab 509*a* and the second tab 513*a*. The first axis 536 extends from the first channel 516*a* to the second channel 519*a*. Additionally, a second axis 539 is shown midway between the first channel 516*a* and the second channel 519*a*. The second axis 539 extends from the first tab 509*a* to the second tab 513*a*. In the embodiment shown in FIGS. 5A-5B, the left panel 206*a* is symmetrical with respect to the first axis 536 and the second axis 539. As such, the left panel 206*a* may be regarded as being two-way symmetrical.

Figure 6:
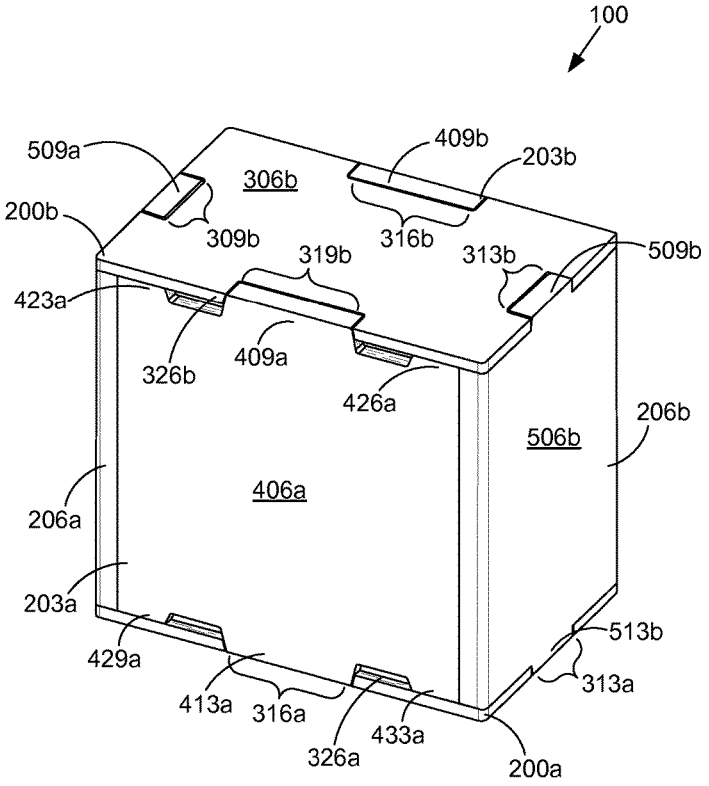
FIG. 6 is another drawing of the container of FIG. 1 according to various embodiments of the present disclosure.

With reference to FIG. 6, shown is the container 100 according to various embodiments of the present disclosure. As shown in FIG. 6, the panels 200*a*-200*b*, 203*a*-203*b*, and 206*a*-206*b* have been assembled to form the container 100.

As shown in FIG. 6, second tab 413*a* of the front panel 203*a* has been inserted into the notch 316*a* of the bottom panel 200*a*. As a result, the front panel 203*a* may be attached to the bottom panel 200*a* by a friction fit. In particular, the second tab 413*a* of the front panel 203*a* in conjunction with the notch 316*a* of the bottom panel 200*a* form a dovetail joint. The amount of surface contact between the front panel 203*a* and the bottom panel 200*a* due to the dovetail joint may be greater than the amount of surface contact that would otherwise result from other types of connections. This relatively large amount of surface contact may restrict air from passing between the front panel 203*a* and the bottom panel 200*a*. Thus, the dovetail joint formed by the second tab 413*a* of the front panel 203*a* and the notch 316*a* of the bottom panel 200*a* may restrict air from entering or escaping the container 100.

The ends of the extensions 429*a*-433*a* of the front panel 203*a* may contact the lip 326*a* of the bottom panel 200*a*. Additionally, there are spaces between the second tab 413*a* and the extensions 429*a*-433*a* of the front panel 203*a*. A person may insert a finger or tool into one or more of the spacings to grip and pry the bottom panel 200*a* away from the front panel 203*a*.

As shown, the second tab 513*a* (FIGS. 4A-4B), referred to herein as the second tab 513*b*, of the right panel 206*b* has been inserted into the notch 313*a* of the bottom panel 200*a*. As a result, the right panel 206*b* may be attached to the bottom panel 200*a* by a friction fit. In particular, the second tab 513*b* of the right panel 206*b* in conjunction with the notch 313*a* of the bottom panel 200*a* form a dovetail joint. Such a dovetail joint may restrict cooled or heated air from escaping the container 100, as described above. Additionally, a portion of the bottom panel 200*a* has been inserted into the recesses 529*a*-533*a* (FIGS. 5A-5B) of the right panel 206*b*.

Furthermore, the second fin 419*a* (FIGS. 4A-4B) of the front panel 203*a* has been inserted into the second channel 519*a* (FIG. 5B) of the right panel 206*b*. As a result, the right panel 206*b* may be attached to the front panel 203*a* by a friction fit. In particular, the second fin 419*a* of the front panel 203*a* is inserted into the second channel 519*a* of the right panel 206*b* form a dado joint due to the sides of the second fin 419*a* being in contact with the sides of the second channel 519*a*. The second fin 419*a* may be inserted so that the end of the second fin 419*a* is very close to or in contact with the bottom of the second channel 519*a*. The amount of surface contact between the front panel 203*a* and the right panel 206*b* due to the dado joint may be greater than the amount of surface contact that would otherwise result from other types of connections. This relatively large amount of surface contact may restrict air from passing between the front panel 203*a* and the right panel 206*b*. Thus, the dado joint formed by the second fin 419*a* of the front panel 203*a* and the second channel 519*a* of the right panel 206*b* may restrict air from entering or escaping the container 100.

Although not visible in FIG. 6, the second tab 513*a* (FIGS. 5A-5B) of the left panel 206*a* has been inserted into the notch 309*a* (FIGS. 3A-3B) of the bottom panel 200*a*. As a result, the left panel 206*a* may be attached to the bottom panel 200*a* by a friction fit. In particular, the second tab 513*a* of the left panel 206*a* in conjunction with the notch 309*a* of the bottom panel 200*a* form a dovetail joint. Such a dovetail joint may restrict air from entering or escaping the container 100, as described above. Additionally, a portion of the bottom panel 200*a* has been inserted into the recesses 529*a*-533*a* (FIGS. 5A-5B) of the left panel 206*a*.

Furthermore, the first fin 416*a* (FIGS. 4A-4B) of the front panel 203*a* has been inserted into the first channel 516*a* (FIG. 5B) of the left panel 206*a*. As a result, the left panel 206*a* may be attached to the front panel 203*a* by a friction fit. In particular, the first fin 416*a* of the front panel 203*a* is inserted into the first channel 516*a* of the left panel 206*a* form a dado joint due to the sides of the first fin 416*a* being in contact with the sides of the first channel 516*a*. The first fin 416*a* may be inserted so that the end of the end of the first fin 416*a* is very close to or in contact with the bottom of the first channel 516*a*. Such a dado joint may restrict air from entering or escaping the container 100, as described above.

Although not visible in FIG. 6, the second tab 413*a* of the rear panel 203*b* has been inserted into the notch 319*a* (FIGS. 3A-3B) of the bottom panel 200*a*. As a result, the front panel 203*a* may be attached to the bottom panel 200*a* by a friction fit. In particular, the second tab 413*a* of the rear panel 203*b* in conjunction with the notch 319*a* of the bottom panel 200*a* form a dovetail joint. Such a dovetail joint may restrict air from entering or escaping the container 100, as described above.

Additionally, the second fin 419*a* of the rear panel 203*b* has been inserted into the second channel 519*a* of the left panel 206*a*. As a result, the rear panel 203*b* may be attached to the left panel 206*a* by a friction fit. In particular, the second fin 419*a* of the rear panel 203*b* in conjunction with the second channel 519*a* of the left panel 206*a* form a dado joint due to the sides of the second fin 419*a* being in contact with the sides of the second channel 519*a*. The second fin 419*a* may be inserted so that the end of the second fin 419*a* is very close to or in contact with the bottom of the second channel 519*a*. Such a dado joint may restrict air from entering or escaping the container 100, as described above.

Similarly, the first fin 416*a* of the rear panel 203*b* has been inserted into the first channel 516*a* of the right panel 206*b*. As a result, the rear panel 203*b* may be attached to the right panel 206*b* by a friction fit. In particular, the first fin 416*a* of the rear panel 203*b* in conjunction with the first channel 516*a* of the right panel 206*b* form a dado joint due to the sides of the first fin 416*a* being in contact with the sides of the first channel 516*a*. The first fin 416*a* may be inserted so that the end of the first fin 416*a* is very close to or in contact with the bottom of the first channel 516*a*. Such a dado joint may restrict air from entering or escaping the container 100, as described above.

As shown in FIG. 6, the first tab 409*a* of the front panel 203*a* has been inserted into the notch 319*a*, referred to herein as the notch 319*b*, of the top panel 200*b*. As a result, the front panel 203*a* may be attached to the top panel 200*b* by a friction fit. In particular, the first tab 409*a* of the front panel 203*a* in conjunction with the notch 319*b* of the top panel 200*b* form a dovetail joint. Such a dovetail joint may restrict air from entering or escaping the container 100, as described above.

The ends of the extensions 423*a*-426*a* of the front panel 203*a* may contact the lip 326*a*, referred to herein as the lip 326*b*, of the top panel 200*b*. Additionally, there are spaces between the first tab 409*a* and the extensions 423*a*-426*a* of the front panel 203*a*. A user may pry the top panel 200*b* away from the front panel 203*a* with the use of a finger or other tool inserted into one or more of the spaces.

Additionally, the first tab 509*a*, referred to herein as the first tab 509*b*, of the right panel 206*b* has been inserted into the notch 313*a*, referred to herein as the notch 313*b*, of the top panel 200*b*. As a result, the right panel 206*b* may be attached to the top panel 200*b* by a friction fit. In particular, the first tab 509*b* of the right panel 203*b* in conjunction with the notch 313*b* of the top panel 200*b* form a dovetail joint. Such a dovetail joint may restrict air from entering or escaping the container 100, as described above. Additionally, a portion of the top panel 200*b* has been inserted into the recesses 523*a*-526*a* (FIG. 5B) of the right panel 206*b*.

Furthermore, the first tab 409*a*, referred to herein as the first tab 409*b*, of the rear panel 203*b* has been inserted into the notch 316*a*, referred to herein as the notch 316*b*, of the top panel 200*b*. As a result, the rear panel 203*b* may be attached to the top panel 200*b* by a friction fit. In particular, the first tab 409*b* of the rear panel 203*b* in conjunction with the notch 316*b* of the top panel 200*b* form a dovetail joint. Such a dovetail joint may restrict air from entering or escaping the container 100, as described above.

Additionally, the first tab 509*a* of the left panel 206*a* has been inserted into the notch 309*a*, referred to herein as the notch 309*b*, of the top panel 200*b*. As a result, the left panel 206*a* may be attached to the top panel 200*b* by a friction fit. In particular, the first tab 509*a* of the left panel 206*a* in conjunction with the notch 309*b* of the top panel 200*b* form a dovetail joint. Such a dovetail joint may restrict air from entering or escaping the container 100, as described above. Additionally, a portion of the top panel 200*b* has been inserted into the recesses 523*a*-526*a* of the left panel 206*a*.

As previously discussed, one or more items, such as food, medicine, a heating element, and/or a refrigerating element may be within the container 100. To this end, the item may be positioned in the container 100 prior to, for example, the top panel 200*b* being attached to the front panel 203*a*, the left panel 206*a*, the right panel 206*b*, and the rear panel 203*b*.

After the container 100 has been assembled, the container 100 and the one or more items therein may be placed in a tote bag 103 (FIG. 1) or any other type of carrier. The tote bag 103 with the container 100 therein may then be loaded onto a truck and delivered to, for example, a customer that ordered the one or more items.

The customer may open the container 100 by, for example, inserting a finger or tool into one or more of the spaces between the first tab 409*a* and the extensions 423*a*-426*a* of the front panel 203*a* and then pulling the top panel 200*b* away from the front panel 203*a*. The one or more items within the container 100 may then be removed, and the container 100 may be disassembled by separating the respective panels 200*a*, 203*a*-203*b*, and 206*a*-206*b*.

In some embodiments, the panels 200*a*-200*b*, 203*a*-203*b*, and 206*a*-206*b* may be returned, for example, to the grocery delivery service or other entity that provided the container 100 and/or the one or more items. The grocery delivery service may have the panels 200*a*-200*b*, 203*a*-203*b*, and 206*a*-206*b* cleaned for re-use for a subsequent order. If one of the panels 200*a*-200*b*, 203*a*-203*b*, and 206*a*-206*b* is damaged, the particular one of the panels 200*a*-200*b*, 203*a*-203*b*, and 206*a*-206*b* that is damaged may be replaced, instead of replacing the entire container 100.

Figure 7:
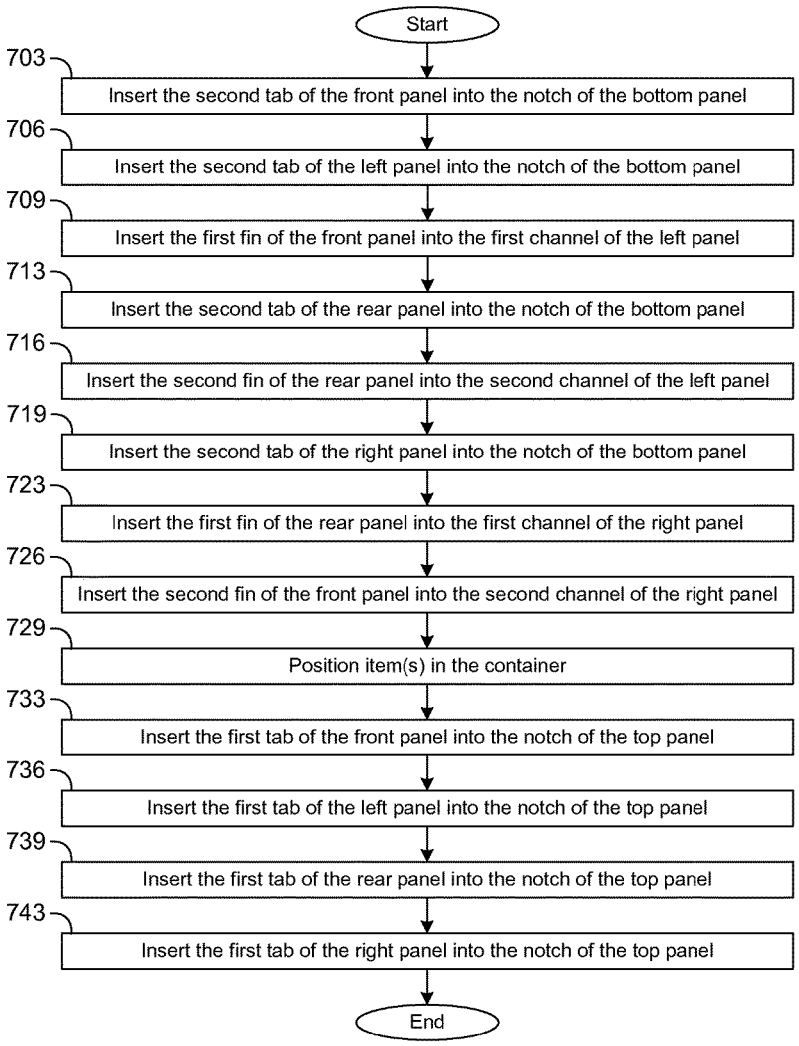
FIG. 7 is a flowchart illustrating an example of the container of FIG. 1 being assembled according to various embodiments of the present disclosure.

With reference to FIG. 7, shown is a flowchart that represents an example of the container 100 (FIG. 1) being assembled according to various embodiments. It is understood that the flowchart of FIG. 7 provides merely an example of the many different types of functional arrangements that may be performed in association with the container 100. The flowchart of FIG. 7 may be viewed as depicting an example of elements of a method implemented to assemble the container 100.

Beginning with box 703, the second tab 413*a* (FIGS. 4A-4B) of the front panel 203*a* (FIG. 2) is inserted into the notch 316*a* (FIGS. 3A-3B) of the bottom panel 200*a* (FIG. 2). As a result, the front panel 203*a* is attached to the bottom panel 200*a*.

As shown at box 706, the second tab 513*a* (FIGS. 5A-5B) of the left panel 206*a* (FIG. 2) is inserted into the notch 309*a* (FIGS. 3A-3B) of the bottom panel 200*a*. At box 709, the first fin 416*a* (FIGS. 4A-4B) of the front panel 203*a* is inserted into the first channel 516*a* (FIG. 5B) of the left panel 206*a*. Thus, after box 709, the left panel 206*a* is attached to the bottom panel 200*a* and the front panel 203*a*. In some embodiments, boxes 706-709 may be performed simultaneously.

The second tab 413*a* of the rear panel 203*b* (FIG. 2) is then inserted into the notch 319*a* (FIGS. 3A-3B) of the bottom panel 200*a*, as shown at box 713. As indicated at box 716, the second fin 419*a* (FIGS. 4A-4B) of the rear panel 203*b* is inserted into the second channel 519*a* (FIG. 5B) of the left panel 206*a*. Thus, the rear panel 203*b* is attached to the bottom panel 200*a* and the left panel 206*a* after box 716. In some embodiments, boxes 713-716 may be performed simultaneously.

As shown at box 719, the second tab 513*b* (FIG. 6) of the right panel 206*b* is inserted into the notch 313*a* of the bottom panel 200*a*. The first fin 416*a* of the rear panel 203*b* is then inserted into the first channel 516*a* of the right panel 206*b*, as indicated at box 723. At box 726, the second fin 419*a* (FIGS. 4A-4B) of the front panel 203*a* is then inserted into the second channel 519*a* of the right panel 206*b*. Thus, the right panel 206*b* is attached to the bottom panel 200*a*, the front panel 203*a*, and the rear panel 203*b* after box 726. In some embodiments, boxes 719-726 may be performed simultaneously.

As indicated in box 729, one or more items may be positioned in the container 100. For example, food, medicine, a heating element, a refrigerating element, and/or any other type of item may be positioned in the container 100.

After one or more items have been positioned in the container 100, the first tab 409*a* (FIGS. 4A-4B) of the front panel 203*a* is inserted into the notch 319*b* (FIG. 6) of the top panel 200*b*, as shown at box 733. Additionally, the first tab 509*a* (FIGS. 5A-5B) of the left panel 206*a* is inserted into the notch 309*b* (FIG. 6) of the top panel 200*b*, as indicated at box 736. As show at box 739, the first tab 409*b* (FIG. 6) of the rear panel 203*b* is inserted into the notch 316*b* of the top panel 200*b*. Then, as shown at box 743, the first tab 509*b* (FIG. 6) of the right panel 206*b* is inserted into the notch 313*b* (FIG. 6) of the top panel 200*b*. Thus, after box 743, the top panel 200*b* is attached to the front panel 203*a*, the rear panel 203*b*, the left panel 206*a*, and the right panel 206*b*. Boxes 733-743 may be performed simultaneously in some embodiments. Thereafter, the process ends.

Figure 8:
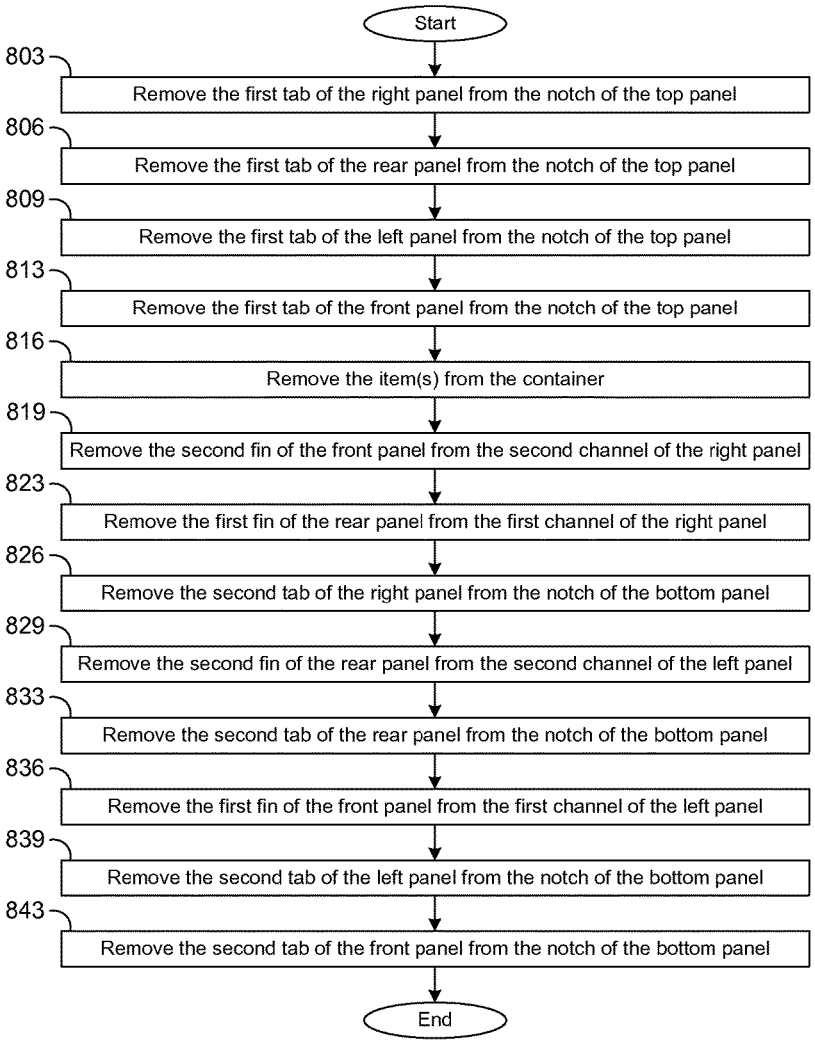
FIG. 8 is a flowchart illustrating an example of the container of FIG. 1 being disassembled according to various embodiments of the present disclosure.

With reference to FIG. 8, shown is a flowchart that represents an example of the container 100 (FIG. 1) being disassembled according to various embodiments. It is understood that the flowchart of FIG. 8 provides merely an example of the many different types of functional arrangements that may be performed in association with the container 100. The flowchart of FIG. 8 may be viewed as depicting an example of elements of a method implemented to disassemble the container 100.

Beginning at box 803, the first tab 509*b* (FIG. 6) of the right panel 206*b* (FIG. 2) is removed from the notch 313*b* (FIG. 6) of the top panel 200*b* (FIG. 2). At box 806, the first tab 409*b* (FIG. 6) of the rear panel 203*b* (FIG. 2) is removed from the notch 316*b* (FIGS. 4A-4B) of the top panel 200*b*. Additionally, as shown at box 809, the first tab 509*a* (FIGS. 5A-5B) of the left panel 206*a* is removed from the notch 309*b* (FIG. 6) of the top panel 200*b*. Furthermore, the first tab 409*a* (FIGS. 4A-4B) of the front panel 203*a* is removed from the notch 319*b* (FIG. 6) of the top panel 200*b*, as indicated at box 813. Thus, after box 813, the top panel 200*b* has been separated from the remainder of the container 100.

Boxes 803-813 may be performed simultaneously in some embodiments. To this end, a person may insert a finger into one or more of the spaces between the first tab 409*a* and the extensions 423*a*-426*a* to grip the top panel 200*b*. Then, the top panel 200*b* may be pulled away from the front panel 203*a*, the left panel 206*a*, the rear panel 203*b*, and the right panel 206*b*.

As shown at box 816, one or more items may then be removed from the container 100. The items may be, for example, food medicine, a heating element, a refrigerating element, and/or any other type of item.

As indicated at box 819, the second fin 419*a* (FIGS. 4A-4B) of the front panel 203*a* is removed from the second channel 519*a* (FIG. 5B) of the right panel 206*b*. The first fin 416*a* of the rear panel 203*b* is then removed from the first channel 516*a* (FIG. 5B) of the right panel 206*b*, as shown at box 823. At box 826, the second tab 513*b* (FIG. 6) of the right panel 206*b* is removed from the notch 313*a* of the bottom panel 200*a*. Thus, after box 826, the right panel 206*b* has been separated from the remainder of the container 100. Boxes 819-826 may be performed simultaneously in some embodiments.

As shown at box 829, the second fin 419*a* of the rear panel 203*b* is removed from the second channel 519*a* (FIG. 5B) of the left panel 206*a*. Additionally, the second tab 413*a* of the rear panel 203*b* is removed from the notch 319*a* (FIGS. 3A-3B) of the bottom panel 200*a*. Thus, after box 833, the right panel 206*b* is separated from the remainder of the container 100. In some embodiments, boxes 829-833 may be performed simultaneously.

The first fin 416*a* of the front panel 203*a* may then be removed from the first channel 516*a* of the left panel 206*a*, as indicated at box 836. As shown at box 839, the second tab 513*a* (FIGS. 5A-5B) of the left panel 206*a* may be removed from the notch 309*a* (FIGS. 3A-3B) of the bottom panel 200*a*. Thus, the left panel 206*a* is separated from the remainder of the container 100 after box 839. In some embodiments, boxes 836-839 may be performed simultaneously.

At box 843, the second tab 413*a* (FIGS. 4A-4B) of the front panel 203*a* is removed from the notch 316*a* (FIGS. 3A-3B) of the bottom panel 200*a*. Thus, the front panel 203*a* and the bottom panel 200*a* are separated after box 843. Thereafter, the process ends.

Although the flowcharts of FIGS. 7-8 show a specific order of execution, it is understood that the order of execution may differ from that which is depicted. For example, the order of execution of two or more boxes may be scrambled relative to the order shown. Also, two or more boxes shown in succession in FIGS. 7-8 may be executed concurrently or with partial concurrence. Further, in some embodiments, one or more of the boxes shown in FIGS. 7-8 may be skipped or omitted. It is understood that all such variations are within the scope of the present disclosure.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It is emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus, comprising:

an insulating container that comprises:

a first panel that comprises a first notch, a second notch, a third notch, and a fourth notch;

a second panel that comprises a fifth notch, a sixth notch, a seventh notch, and an eighth notch, wherein the second panel is identical to the first panel;

a third panel that comprises a first tab and a second tab, wherein the first tab is inserted into the first notch of the first panel and forms a first dovetail joint, wherein the second tab is inserted into the fifth notch of the second panel and forms a second dovetail joint;

a fourth panel that comprises a third tab and a fourth tab, wherein the third tab is inserted into the second notch of the first panel and forms a third dovetail joint, wherein the fourth tab is inserted into the sixth notch of the second panel and forms a fourth dovetail joint, wherein the fourth panel is identical to the third panel;

a fifth panel that comprises a fifth tab and a sixth tab, wherein the fifth tab is inserted into the third notch of the first panel and forms a fifth dovetail joint, wherein the sixth tab is inserted into the seventh notch of the second panel and forms a sixth dovetail joint;

a sixth panel that comprises a seventh tab and an eighth tab, wherein the seventh tab is inserted into the fourth notch of the first panel and forms a seventh dovetail joint, wherein the eighth tab is inserted into the eighth notch of the second panel and forms an eighth dovetail joint, wherein the sixth panel is identical to the fifth panel; and wherein a sealed cavity is formed by the first panel, the second panel, the third panel, the fourth panel, the fifth panel, the sixth panel, the first dovetail joint, the second dovetail joint, the third dovetail joint the fourth dovetail joint, the fifth dovetail joint, the sixth dovetail joint, the seventh dovetail joint, and the eighth dovetail joint; and wherein the sealed cavity is configured to contain a perishable item.

2. The apparatus of claim 1, wherein the insulating container is configured to be positioned in a tote bag for transport.

3. The apparatus of claim 1, wherein the first panel comprises a plurality of protrusions on an interior surface of the first panel, wherein the plurality of protrusions provide a space between the perishable item and the interior surface of the first panel.

4. An apparatus, comprising:

an insulating container base panel that comprises a first notch, a second notch, a third notch, and a fourth notch;

an insulating container side panel that comprises a first tab that is configured to be removably inserted into the first notch of the insulating container base panel, wherein the first tab and the first notch are configured to form a first detachable dovetail joint;

an insulating container end panel that comprises a second tab that is configured to be removably inserted into the second notch of the insulating container base panel, wherein the second tab and the second notch are configured to form a second detachable dovetail joint;

an additional insulating container side panel that comprises a third tab that is configured to be removably inserted into the third notch of the insulating container base panel, wherein the third tab and the third notch are configured to form a third detachable dovetail joint;

an additional insulating container end panel that comprises a fourth tab that is configured to be removably inserted into the fourth notch of the insulating container base panel, wherein the fourth tab and the fourth notch are configured to form a fourth detachable dovetail joint; and an insulating container lid panel that is configured to removably attach to the insulating container side panel, the additional insulating container side panel, the insulating container end panel, and the additional insulating container end panel;

wherein a sealed cavity is formed by the insulating container lid panel, the insulating container side panel, the additional insulating container side panel, the insulating container end panel, the additional insulating container end panel, the insulating container base panel, the first detachable dovetail joint, the second detachable dovetail joint, the third detachable dovetail joint, and the fourth detachable dovetail joint.

5. The apparatus of claim 4, wherein the insulating container lid panel comprises a fifth notch, a sixth notch, a seventh notch, and an eighth notch; and wherein:

the insulating container side panel further comprises a fifth tab that is configured to be removably inserted into the fifth notch in the sixth insulating container lid panel, wherein the fifth tab and the fifth notch are configured to form a fifth detachable dovetail joint;

the insulating container end panel further comprises a sixth tab that is configured to be removably inserted into the sixth notch in the sixth insulating container lid panel, wherein the sixth tab and the sixth notch are configured to form a sixth detachable dovetail joint;

the additional insulating container side panel further comprises a seventh tab that is configured to be removably inserted into the seventh notch in the insulating container lid panel, wherein the seventh tab and the seventh notch are configured to form a seventh detachable dovetail joint; and the additional insulating container end panel further comprises an eighth tab that is configured to be removably inserted into the eighth notch in the insulating container lid panel, wherein the eighth tab and the eighth notch are configured to form an eighth detachable dovetail joint.

6. The apparatus of claim 5, wherein the insulating container side panel further comprises an extension so that a space is formed between the extension and the fifth tab of the insulating container side panel.

7. The apparatus of claim 6, wherein the space is configured to facilitate a grip to facilitate a manual separation of the insulating container lid panel from the insulating container panel side panel.

8. The apparatus of claim 5, wherein the insulating container base panel is substantially identical to the insulating container lid panel.

9. The apparatus of claim 4, wherein:

the insulating container end panel further comprises a first channel; and the insulating container side panel further comprises a first fin that is configured to be removably inserted into the first channel in the insulating container end panel to form a first detachable dado joint.

10. The apparatus of claim 9, wherein:

the insulating container end panel further comprises a second channel; and the additional insulating container side panel further comprises a second fin that is configured to be removably inserted into the second channel in the additional insulating container end panel to form a second detachable dado joint.

11. The apparatus of claim 9, wherein:

the additional insulating container end panel further comprises a second channel; and the insulating container side panel further comprises a second fin that is configured to be removably inserted into the second channel to form a second detachable dado joint.

12. The apparatus of claim 4, wherein the insulating container base panel comprises a plurality of protrusions that extend from an interior surface of the insulating container base panel.

13. The apparatus of claim 4, wherein the insulating container side panel is substantially identical to the additional insulating container side panel.

14. The apparatus of claim 4, wherein the insulating container end panel is substantially identical to the additional insulating container end panel.

15. A method, comprising:

removably inserting a first fin of an insulating container side panel into a first channel in an insulating container end panel to form a first detachable dado joint;

removably inserting a second fin of the insulating container side panel into a second channel in an additional insulating container end panel to form a second detachable dado joint;

removably inserting a third fin of an additional insulating container side panel into a third channel in the insulating container end panel to form a third detachable dado joint;

removably inserting a fourth fin of the additional insulating container side panel into a fourth channel in the additional insulating container end panel to form a fourth detachable dado joint;

removably attaching an insulating container base panel to the insulating container side panel, the additional insulating container side panel, the insulating container end panel, and the additional insulating container end panel; and removably attaching an insulating container lid panel to the insulating container side panel, the additional insulating container side panel, the insulating container end panel, and the additional insulating container end panel;

wherein the insulating container base panel, the insulating container side panel, the additional insulating container side panel, the insulating container end panel, the additional insulating container end panel, the insulating container lid panel, the first detachable dado joint, the second detachable dado joint, the third detachable dado joint, and the fourth detachable dado joint form a sealed container.

16. The method of claim 15, further comprising:

removably inserting a first tab of the insulating container side panel into a first notch in the insulating container base panel to form a first detachable dovetail joint; and removably inserting a second tab of the additional insulating container side panel into a second notch in the insulating container base panel to form a second detachable dovetail joint.

17. The method of claim 16, further comprising:

removably inserting a third tab of the insulating container side panel into a third notch in the insulating container lid panel to form a third detachable dovetail joint; and removably inserting a fourth tab of the additional insulating container side panel into a fourth notch in the insulating container lid panel to form a fourth detachable dovetail joint.

18. The method of claim 15, further comprising positioning a food item in a region between the insulating container side panel, the insulating container end panel, the additional insulating container end panel, and the additional insulating container side panel.

19. The method of claim 18, further comprising positioning a refrigerating element in the region between the insulating container side panel, the insulating container end panel, the additional insulating container end panel, and the additional insulating container side panel to regulate a temperature of the food item.

20. The method of claim 19, further comprising positioning the insulating container side panel, the insulating container end panel, the additional insulating container end panel, the additional insulating container side panel, the food item, and the refrigerating element into a tote bag.

21. The method of claim 19, wherein at least one of:

the insulating container side panel is two-way symmetrical;

the insulating container end panel is two-way symmetrical;

the additional insulating container end panel is two-way symmetrical; or the additional insulating container side panel is two-way symmetrical.

* * * * *